United States Patent [19]

Henle

[11] 3,931,907

[45] Jan. 13, 1976

[54] COMBINATION WATER SUPPLY AND WASTE HOLDING TANK

[76] Inventor: George A. Henle, 920 Penfield St., Beecher, Ill. 60401

[22] Filed: Jan. 15, 1975

[21] Appl. No.: 541,225

[52] U.S. Cl. ..... 220/22; 220/85 B; 280/5 A
[51] Int. Cl.[2] ..... B65D 87/16; B65D 25/04
[58] Field of Search ..... 220/16, 17, 22, 85 B; 280/5 A, 5 E

[56] References Cited

UNITED STATES PATENTS

| | | | |
|---|---|---|---|
| 3,172,556 | 3/1965 | Stiefel | 220/85 B |
| 3,275,418 | 9/1966 | Nee | 220/85 B |
| 3,811,460 | 5/1974 | Capdevielle | 220/85 B |

FOREIGN PATENTS OR APPLICATIONS

| | | | |
|---|---|---|---|
| 1,102,794 | 3/1961 | Germany | 220/22 |
| 376,537 | 5/1964 | Switzerland | 220/85 B |

*Primary Examiner*—George E. Lowrance
*Attorney, Agent, or Firm*—Wegner, Stellman, McCord, Wiles & Wood

[57] ABSTRACT

A combination fresh water supply and waste holding tank for use in mobile structures such as vehicles. The tank includes separate half shell portions and an extensible divider wall extending across the internal tank space between the half shell portions. A fresh water supply holding structure is provided in one portion of the shell spaces defined by the divider wall and a waste holding structure is provided in the other portion of the spaces defined by the divider wall. Each of the divider wall, fresh water supply holding structure and waste holding structure are extensible whereby selectively substantially the entire internal space of the shell may be occupied by the fresh water supply holding structure and fresh water therein, or substantially the entire internal space of the shell may be occupied by the waste holding structure and waste therein. The tank is arranged to be substantially full at all times with fresh water drawn from the supply being volumetrically compensated by waste delivered to the waste holding structure.

14 Claims, 5 Drawing Figures

COMBINATION WATER SUPPLY AND WASTE HOLDING TANK

BACKGROUND OF THE INVENTION

1. Field of the Invention

This invention relates to liquid holding tanks and in particular to tanks arranged for selectively holding variable quantities of different liquids.

2. Description of the Prior Art

In the conventional mobile vehicle, such as a trailer, boat, and the like, it is desirable to provide facilities for storing a fresh water supply. Further, in such vehicles, it is desirable to provide facilities for temporarily storing liquid waste. Conventionally, such fresh water supplies and liquid waste holding means have comprised separate tanks carried by the mobile vehicle. The use of such separate tanks is relatively costly not only in the cost of the original tank apparatus, but further in the use of valuable space, as in most such mobile vehicles, space is at a premium.

One waste disposal device for use as a portable disposable means is shown in U.S. Pat. No. 3,321,103 of Henry E. Phillips. The Phillips device utilizes a disposable bag for receiving and holding the waste and means for removably connecting the bag to the apparatus for subsequent removal and disposal.

SUMMARY OF THE INVENTION

The present invention comprehends an improved tank structure for use in mobile vehicles and the like which provides improved compact storing of a fresh water supply and holding of liquid waste for facilitated disposal.

More specifically, the present invention comprehends an improved combination fresh water supply and liquid waste holding tank. The tank may be comprised of separable bottom and upper half shells with means for securing the half shells together. An extensible divider wall is sealingly secured between the half shells to divide the interior space of the shell into a fresh water supply portion and a liquid waste holding portion.

A first flexible holding means is provided in the fresh water supply portion for receiving, holding, and delivering fresh water. A second flexible holding means is provided in the waste holding portion for receiving, holding, and discharging liquid waste.

Suitable port means are provided in the shell for passing fresh water into and from the fresh water supply means and for passing waste into and from the liquid waste holding means.

The tank structure is readily disassemblable for facilitated cleaning when desired. In the illustrated embodiment, each of the divider wall and flexible holding means is peripherally sealingly secured between the shell halves by the securing means.

In the illustrated embodiment, the side walls of the half shells are generally triangular. The side walls are complementary so as to define, in the secured arrangement, a parallelepiped shell with the divider wall extending substantially diagonally across the interior thereof.

The waste inlet may comprise a vertical T-duct having a lower end adjacent a corner edge of the bottom half shell for effectively precluding obstruction thereby by the extended divider wall and flexible holding means when the tank is substantially full of fresh water. The upper portion of the T-duct defines a first end opening upwardly through a top corner edge portion of the bottom half shell, and a second end opening horizontally through the end wall thereof.

A number of tank arrangements utilizing collapsible walls have been used heretofore. Thus, in U.S. Pat. No. 1,731,767 of George F. Cramer, a dispensing device is shown utilizing a collapsible bag which is collapsed within a metal tank by incoming pressurized water to force out liquid to be sprayed from the bag. In U.S. Pat. No. 3,112,845 of Frederick Bryant, a bulk fluid transport is shown wherein a pair of flexible bags are disposed within an outer tank for permitting different liquid loads to be provided in the different bags. In U.S. Pat. No. 3,477,611 of Harold T. Niles, a fuel tank having reduced fuel vapor emission is provided with a flexible diaphragm for dividing the tank into air and fuel chambers.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3, 4, 5:
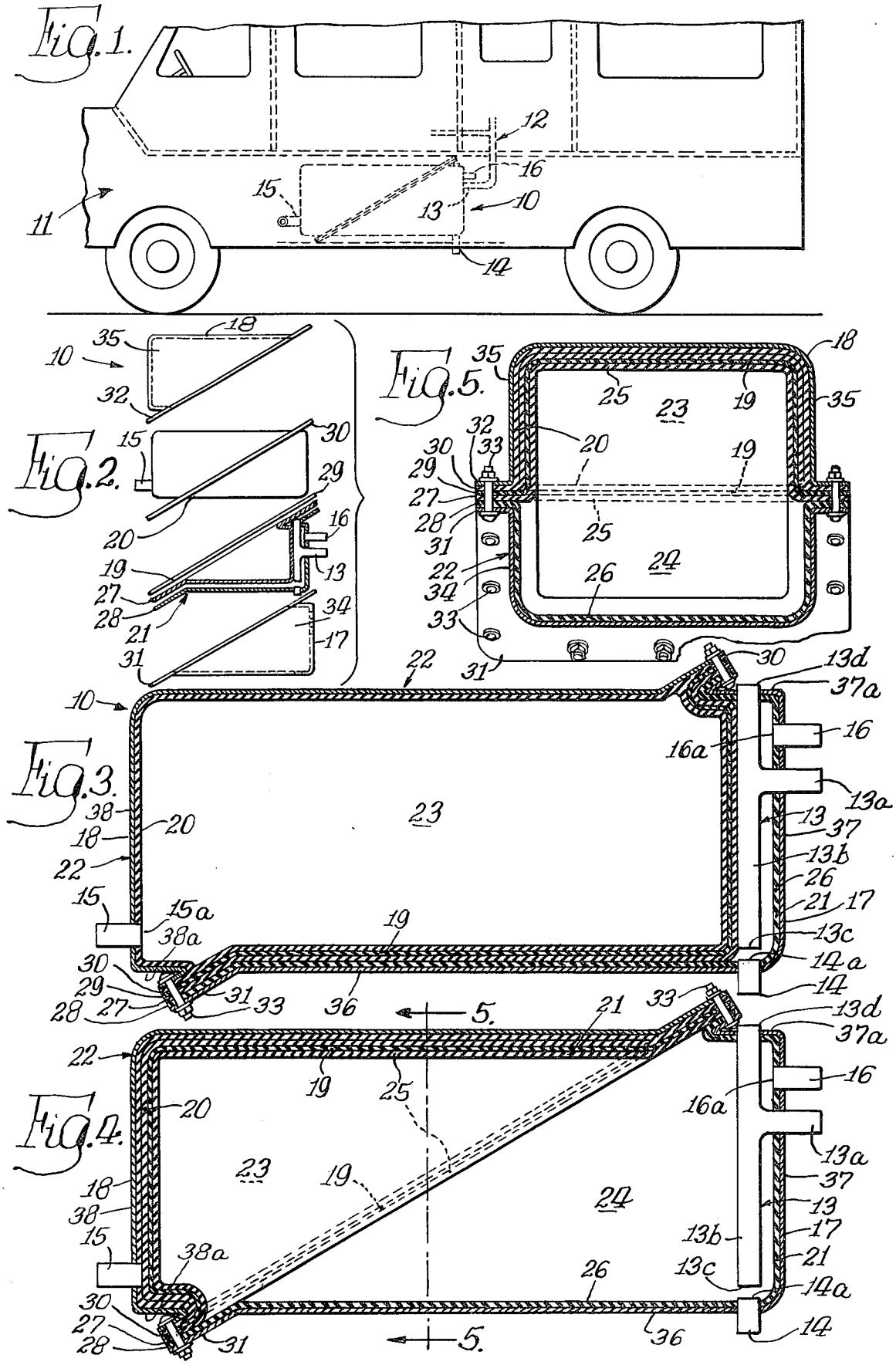
FIG. 1 is a fragmentary side elevation of a mobile vehicle provided with a combination fresh water supply and liquid waste holding tank embodying the invention.
FIG. 2 is an exploded side elevation partially in section of the elements of the tank.
FIG. 3 is a vertical section of the assembled tank as arranged when filled with fresh water.
FIG. 4 is a vertical section of the assembled tank as arranged when filled with liquid waste with the divider wall and flexible holding means being illustrated in an intermediate position in broken lines.
FIG. 5 is a vertical section taken along the line 5—5 of FIG. 4, with the dotted lines showing the intermediate position of the divider wall.

In the exemplary embodiment of the invention as disclosed in the drawing, a combination fresh water supply and liquid waste holding tank generally designated 10 is mounted in a mobile vehicle generally designated 11 illustratively comprising an automotive vehicle, it being understood that the vehicle may be of any type including boats, trailers, etc. The tank may be connected by suitable piping generally designated 12 to appliances of the vehicle (not shown). In the illustrated embodiment, the tank includes a waste liquid inlet 13, a waste liquid outlet 14, a fresh water supply inlet and outlet 15, and a waste flushing inlet 16.

As shown in FIG. 2, tank 10 includes a bottom half shell 17, an upper half shell 18, an extensible divider wall 19, a first flexible lower holding means 20, and second flexible upper holding means generally designated 21. In the assembled arrangement of the tank, the bottom and upper half shells are joined to define a complete hollow shell generally designated 22 which is internally divided by the divider wall into an upper fresh water space 23 and a lower liquid waste space 24, as shown in dotted lines in FIG. 4. As further illustrated in FIGS. 3 and 4, the first flexible holding means 20 is disposed within the shell above the divider wall 19 and, thus, when the holding means 20 is filled with fresh water, it occupies substantially the entire volume of the shell. The second holding means 21 includes an upper sheet 25 and a lower sheet 26. The peripheral portion 27 of upper sheet 25 and the peripheral portion 28 of lower sheet 26 are sealingly secured whereby sheets 25 and 26 define an extensible container which, when filled with waste liquid as shown in FIG. 4, substantially fills the shell 22. As illustrated in dotted lines in FIG. 4, the divider wall gradually moves from the lower position of FIG. 3 to the upper position of FIG. 4 as fresh water is delivered from the first holding means 20 and is replaced by liquid waste in the second holding means 21. Thus, as illustrated in FIG. 4, the tank is maintained substantially full of liquid at all times starting with a tank full of fresh water and ending with a tank full of liquid waste in the normal use of the apparatus.

Divider wall 19 defines a peripheral portion 29 and upper holding means 20 defines a peripheral portion 30. As shown in FIGS. 3–5, the peripheral portions 29-30 are substantially congruent and overlying, being sealingly clamped between an outturned flange 31 of the bottom half shell and a corresponding outturned flange 32 of the upper half shell by suitable securing means, such as bolts 33. As illustrated in FIG. 2, in the disclosed embodiment, bottom half shell 17 is provided with triangular side walls 34 and upper half shell 18 is provided with complementary triangular side walls 35, it being understood that any suitable half shell configuration may be utilized within the scope of the invention. The triangular side wall half shell is advantageous in providing facilitated cleaning of the interior thereof upon disassembly of the tank.

As indicated briefly above, fresh water is introduced into the upper flexible holding means 20 through an inlet and outlet duct 15 which defines a port 15*a* in the holding means 20, as shown in FIG. 3. Waste is delivered into the lower holding means 21 through the waste inlet 13 which, as shown in FIG. 3, may comprise a T-tube having an upper horizontal leg 13*a* extending through the tank and into the lower holding means 21 with a downturned leg 13*b* defining an inlet port 13*c* within holding means 21 closely adjacent the bottom wall 36 of the bottom half shell 17. The upper end 13*d* of the waste inlet tube extends vertically through the inturned top edge portion 37*a* of end wall 37 for facilitated use as in marine installation. As shown in FIG. 3, the duct portion 13*a* extends through the upright end wall 37 of shell portion 17 adjacent the top thereof and slightly below and laterally of the fresh water inlet 16 which extends through end wall 37 and sheet 26 to define an inlet port 16*a* opening into lower waste holding means 21. Waste inlet end 13*d* may be suitably capped where the apparatus is used in a motor home installation. Similarly, outlet 14 may be capped where the apparatus is used in a marine installation.

Waste outlet 14 comprises a duct extending upwardly through bottom wall 36 and sheet 26 directly below inlet port 13*c* to define an outlet port 14*a* opening into waste holding means 21. As will be obvious to those skilled in the art, other suitable arrangements of the inlet and outlet ducts may be employed within the scope of the invention.

As indicated above, bottom half shell end wall 37 defines an inturned upper edge portion 37*a*. Similarly upper half shell end wall 38 may be provided with an inturned lower edge portion 38*a* to provide generally bilateral symmetry in the tank configuration.

The divider wall 19 is preferably formed of a resiliently extensible material adapted to readily flex to the lower position of FIG. 3 and to the upper position of FIG. 4 and effectively positively divides the fresh water space from the waste space in the tank. The upper holding means 20 may comprise a sealed bag formed of resilient material and the lower holding means may comprise resilient sheets 25 and 26 facilitating the cleaning of the lower holding means upon removal from the tank when desired. Illustratively, the tank may have a capacity of approximately 50 gallons for use in a motor home mobile vehicle. Divider wall 19 cooperates with each of the respective half shells to define effectively two half tanks, each of which is provided with its own separate flexible liquid holding means whereby the unique cooperating arrangement of the two half shells permits the liquid holding means having the greater volume of liquid therein to extend into the opposite half shell which is effectively correspondingly modified in its external configuration by the adjustment of the arrangement of the divider wall.

The foregoing disclosure of specific embodiments is illustrative of the broad inventive concepts comprehended by the invention.

I claim:

1. A combination fresh water supply and liquid waste holding tank for use in mobile vehicles, comprising:

a bottom half shell defined by a bottom wall, an upright end wall at one end of the bottom wall, and opposed side walls extending downwardly from the top of said end wall to the opposite end of the bottom wall;

an upper half shell defined by a top wall, a depending end wall at one end of the top wall, and opposed side walls extending upwardly from the bottom of said end wall to the opposite end of the top wall;

means for securing said half shells together with the lower edge of the upper half shell side walls juxtaposed to the upper edge of the lower half shell side walls to define a parallelepiped shell;

an extensible divider wall sealingly secured between said half shells and being extensible selectively fully upwardly into said upper half shell and fully downwardly into said lower half shell;

first flexible holding means for holding fresh water disposed within the shell above said divider wall;

second flexible holding means for holding waste disposed within the shell below said divider wall;

first port means for passing fresh water through said shell into and from said first flexible holding means; and second port means for passing waste through said shell into and from said second flexible holding means.

2. The fresh water supply and liquid waste holding tank of claim 1 wherein said divider wall defines a peripheral flange sealingly secured between said half shells.

3. The fresh water supply and liquid waste holding tank of claim 1 wherein said divider wall defines a peripheral flange sealingly secured between said half shells and said first flexible holding means comprises a bag having a peripheral flange sealingly secured with said divider wall flange between said half shells.

4. The fresh water supply and liquid waste holding tank of claim 1 wherein said divider wall defines a peripheral flange sealingly secured between said half shells and said first flexible holding means comprises a parallelepiped bag having a diagonal peripheral flange sealingly secured with said divider wall flange between said half shells.

5. The fresh water supply and liquid waste holding tank of claim 1 wherein said second flexible holding means comprises a pair of flexible sheets having peripheral portions sealingly secured between said half shells.

6. The fresh water supply and liquid waste holding tank of claim 1 wherein said first port means comprises a single duct for passing fresh water therethrough into said first flexible holding means for storage therein, and delivering the stored fresh water from said first flexible holding means when desired.

7. The fresh water supply and liquid waste holding tank of claim 1 wherein said second port means comprises a duct opening through said bottom half shell at the top thereof and extending downwardly therein to adjacent said bottom wall.

8. The fresh water supply and liquid waste holding tank of claim 1 wherein said half shells define complementary peripheral flanges, and said securing means comprises means for sealingly clamping the periphery of each of said divider wall and flexible holding means between said flanges.

9. A combination fresh water supply and liquid waste holding means for use in mobile vehicles, comprising:

a lower, upwardly opening tank structure;

an upper, downwardly opening tank structure;

means for securing said tank structure together with the lower edge portion of the upper tank structure juxtaposed to the upper edge portion of the lower tank structure to define upper and lower confronting tank spaces;

an extensible divider wall sealingly secured between said tank structures and being extensible selectively fully upwardly into said upper tank structure and fully downwardly into said lower tank structure;

first flexible holding means disposed within the tank space above said divider wall for holding fresh water;

second flexible holding means disposed within the tank space below said divider wall for holding liquid waste;

first port means for passing fresh water into and from said first flexible holding means; and second port means for passing liquid waste into and from said second flexible holding means.

10. The fresh water supply and liquid waste holding means of claim 9 wherein said divider wall is resilient.

11. The fresh water supply and liquid waste holding means of claim 9 wherein said securing means sealingly clamps a peripheral portion of said divider wall between said tank structures.

12. The fresh water supply and liquid waste holding means of claim 9 wherein said securing means sealingly clamps a peripheral portion of said flexible holding means between said tank structures.

13. The fresh water supply and liquid waste holding means of claim 9 wherein said second port means includes means for passing flushing water into said second flexible holding means.

14. The fresh water supply and liquid waste holding means of claim 9 wherein said upper edge portion of said bottom tank structure, and said lower edge portion of said upper tank structure define outturned flanges, said securing means being arranged to clamp said flanges, divider wall, and holding means sealingly together.

* * * * *